US005876565A

United States Patent [19]

Laapotti

[11] Patent Number: 5,876,565

[45] **Date of Patent: *Mar. 2, 1999**

[54] PRESS SECTION WITH AN EQUALIZING NIP FOR COMPENSATING FOR ELONGATION OF A PAPER WEB

[75] Inventor: Jorma Laapotti, Palokka, Finland

[73] Assignee: Valmet Corporation, Helsinki, Finland

[ * ] Notice: The term of this patent shall not extend beyond the expiration date of Pat. No. 5,662,778.

[21] Appl. No.: 870,790

[22] Filed: Jun. 6, 1997

Related U.S. Application Data

[63] Continuation-in-part of Ser. No. 540,084, Oct. 6, 1995, Pat. No. 5,662,778.

[30] Foreign Application Priority Data

Oct. 6, 1994 [FI] Finland ..... 944674

[51] Int. Cl.[6] ..... D21F 3/04

[52] U.S. Cl. ..... 162/360.2; 162/359.1; 162/360.3; 162/358.5

[58] Field of Search ..... 162/205, 206, 162/358.3, 358.5, 360.2, 360.3, 306, 359.1

[56] References Cited

U.S. PATENT DOCUMENTS

| | | | |
|---|---|---|---|
| 4,483,745 | 11/1984 | Wicks et al. | 162/206 |
| 4,526,655 | 7/1985 | Karvinen et al. | 162/360.2 |
| 4,566,946 | 1/1986 | Koponen et al. | 162/359 |
| 4,931,143 | 6/1990 | Karvinen et al. | 162/360.1 |
| 4,943,351 | 7/1990 | Wedel | 162/307 |
| 4,976,820 | 12/1990 | Laapotti | 162/206 |
| 5,240,563 | 8/1993 | Karvinen et al. | 162/360.3 |
| 5,389,205 | 2/1995 | Pajula et al. | 162/205 |
| 5,545,295 | 8/1996 | Fujita et al. | 162/360.3 |

FOREIGN PATENT DOCUMENTS

| | | |
|---|---|---|
| 2126617 | 12/1994 | Canada . |
| 0487483 | 5/1992 | European Pat. Off. . |
| 64823 | 9/1983 | Finland . |
| 905798 | 5/1992 | Finland . |
| 3515575 | 11/1985 | Germany . |
| 9206340 | 9/1992 | Germany . |
| 4321406 | 11/1993 | Germany . |
| 2127448 | 4/1984 | United Kingdom . |

*Primary Examiner*—Karen M. Hastings
*Attorney, Agent, or Firm*—Steinberg & Raskin, P.C.

[57] ABSTRACT

A press section in a paper machine through which a paper web has a closed and supported draw and a method and arrangement for compensating for elongation of the web in an equalizing press nip in the press section. The press section has at least two successive separate nips and dewatering of the paper web is carried out at least in the first one of these nips, preferably between two press fabrics that receive water. The last press nip in a running direction of the web is the equalizing press nip which may be separate from the preceding nip and in which no substantial dewatering is performed. The web may be passed through the equalizing press nip from the preceding dewatering press nip on a transfer belt substantially non-water-receiving. After the equalizing nip, the elongation of the paper web in the machine direction, which elongation takes place in the equalizing nip, is compensated for by a difference in speed of the transfer belt.

21 Claims, 13 Drawing Sheets

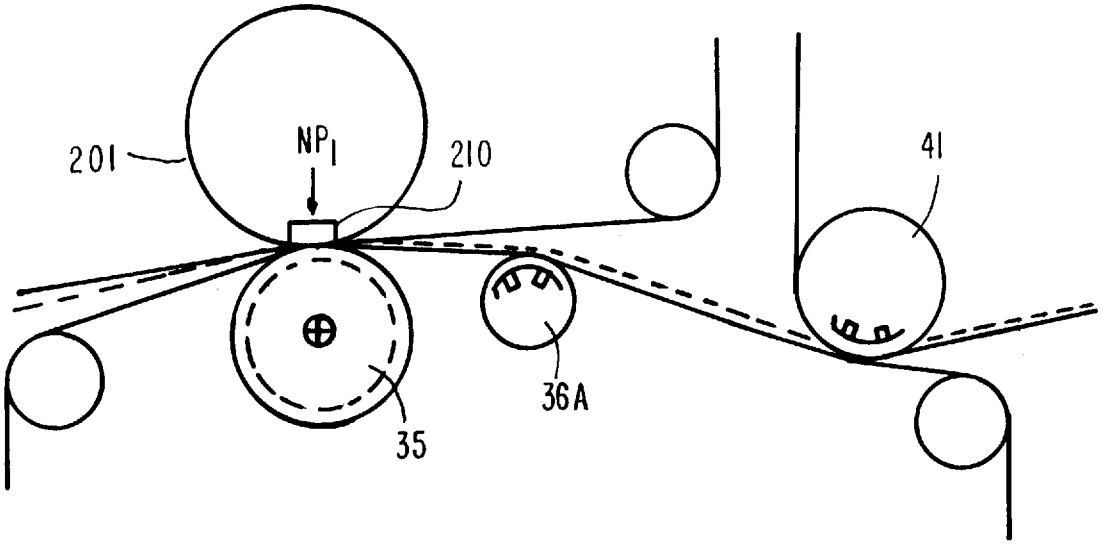
FIG. IA

PRESS SECTION WITH AN EQUALIZING NIP FOR COMPENSATING FOR ELONGATION OF A PAPER WEB

RELATED APPLICATION

This application is a continuation-in-part of U.S. patent application Ser. No. 08/540,084 filed Oct. 6, 1995 now U.S. Pat. No. 5,662,778.

FIELD OF THE INVENTION

The present invention relates to methods and arrangements for compensating for elongation of a paper web in an equalizing nip in a press section in a paper machine. The present invention also relates to a press section in a paper machine, through which press section the paper web has a substantially closed and supported draw. The press section comprises one or more dewatering press nips in which the web is dewatered, preferably while it is being carried between two press fabrics, and an equalizing nip arranged after a last one of the one or more dewatering press nips.

BACKGROUND OF THE INVENTION

One of the most important quality requirements of all paper and board grades is uniformity of the structure both on the micro scale and on the macro scale. The structure of paper, in particular of printing paper, must also be symmetric. The good printing properties required from printing paper mean equal good smoothness, evenness, and certain absorption properties of both faces of the web from which the paper will be produced. The properties of paper, such as the symmetry of surface roughness and density, are affected to a considerable extent by the operation of the press section of the paper machine in which the web is produced, which operation also has a decisive significance for the uniformity of the profiles of the paper in the cross direction and in the machine direction.

Increased running speeds of paper machines create new problems to be solved, which problems are mostly related to the runnability of the machine. Currently, running speeds of up to about 1500 meters per minute are employed. At these running speeds, so-called closed press sections, which comprise a compact combination of press rolls fitted around a smooth-faced center roll, usually operate satisfactorily. As examples of such press sections, reference should be made to the current assignee's "Sym-Press II"™ and "Sym-Press O"™ press sections.

From the point of view of energy economy, dewatering taking place by pressing is preferable to dewatering taking place by evaporation. For this reason, attempts should be made to remove a maximum amount of water out of the paper web by pressing in order that the proportion of water to be removed by evaporation can be made as little as possible. Increased running speeds of paper machines, however, create new, so far not absolutely, satisfactorily solved, problems expressly for the dewatering taking place by pressing, because the press impulse cannot be increased sufficiently by the means known in the prior art, above all because at high speeds the nip times remain inadequately short and, on the other hand, the peak pressure of pressing cannot be increased beyond a certain limit without destruction of the structure of the web.

In typical prior art press sections, the single-felt last press nip tends to produce a poor symmetry of roughness, in particular with fine paper and with LWC and MWC base paper. Also, an uneven z-directional density profile may be a problem especially on SC-paper. These problems are manifested with particular emphasis when the press impulse is high, as is the case with an extended-nip press in the last press position. For example, with MWC base paper, with the current assignee's test paper machine, when non-calendered, for top-face/bottom-face Bendtsen roughness the value 0.52 was obtained, when the press load was about 800 kN per meter in a "Sym-Belt S"™ press, the length of the press shoe was about 152 mm, and the smooth press roll was in the upper position of the single-felt press nip. The high asymmetry of roughness constitutes a limitation for the extent of press load, for the dry solids content that can be achieved, and for the wet strength.

A typical environment of application of the present invention, to which environment the present invention is, however, not restricted, is represented by the current assignee's Finnish Patent Application 905798 (filed Nov. 23, 1990) and by corresponding U.S. patent application Ser. Nos. 07/795,043 and 08/026,851, the later of which matured into U.S. Pat. No. 5,389,205, the specification of which is hereby incorporated by reference herein.

It is known from the prior art to employ so-called equalizing presses in connection with various press sections, including extended-nip press sections. By means of the equalizing presses, attempts are made to equalize the above asymmetry of roughness. With respect to these prior-art equalizing presses, reference is made, for example, to the current assignee's Finnish Patent No. 64,823, to the published German Patent Application No. DE 4,321,406 A1 of Messrs. J. M. Voith GmbH, and to the German Utility Model G 9,206,340.3 of Messrs. Sulzer-Escher Wyss GmbH. By means of the equalizing presses known from the papers mentioned above, it has, however, not been possible to solve the problems related to asymmetry of roughness in a satisfactory way, in particular not in connection with a supported transfer of the web. Of the cited papers mentioned above, the German Utility Model is most closely related to the present invention, in particular the embodiment illustrated in FIG. 12 in that document. In the equalizing press illustrated in FIG. 12 therein, the lower press roll 11 in the equalizing press 5/11 curves the transfer belt 12 and the web over a considerably large angle, and moreover, in connection with the same lower press roll 11, a web transfer nip has been formed by means of a suction roll. Thus, in that construction, it is impossible to make use of differences in speed, by whose means it would be possible to tighten the web after the equalizing press 5/11 so as to eliminate the effects of elongation of the web taking place in the equalizing press. Moreover, in that construction, the abrupt angle of change in direction in a sensitive area directly after the equalizing press restricts the speed of operation of the press.

OBJECTS AND SUMMARY OF THE INVENTION

Accordingly, it is an object of the present invention to provide new and improved press sections avoiding these drawbacks and further development of the prior art most closely related to the present invention.

It is another object of the present invention to provide new and improved methods and arrangements for compensating for elongation of a web in an equalizing nip.

In view of achieving the objects stated above and others, the invention is mainly characterized in that the last press nip in the press section is an equalizing press nip which is most often separate from the preceding nip and in which no substantial dewatering is performed. The paper web is passed through the equalizing press nip from the preceding dewatering press nip on a substantially non-water-receiving transfer belt which has a substantially straight run after the equalizing nip. On the straight run after the equalizing nip, it is possible to compensate for at least a portion of the elongation of the paper web in the machine direction, which elongation takes place in the equalizing nip, by means of the difference in speed of the transfer belt. This compensation may be provided by regulation means which regulate a running speed of the transfer belt to compensate, in a run of the transfer belt from the equalizing nip to a transfer point of the web therefrom to the drying wire, for the elongation of the web in the equalizing nip. The regulation means are structured and arranged to provide the transfer belt with variable speeds, a higher speed when increased compensation for elongation of the web is required.

In certain embodiments of the invention, the web is transferred from the last dewatering nip in the press section, which is preferably an extended nip, on a transfer belt as a substantially linear run through the equalizing press so that the joint run of the transfer belt and the web continues as a substantially straight run also after the equalizing nip. On this straight run of the transfer belt and the web after the equalizing nip, the transfer belt can be extended or stretched to some extent so that the elongation of the web taking place in the equalizing press can be compensated for and the web can be kept tight and reliably in contact with the transfer belt. On the straight run of the transfer belt and the web, a convex suction-transfer sector can also be arranged favorably, on which sector the web can be transferred reliably onto the drying wire of the dryer section of the paper machine while using a minimal angle of change in direction.

In a preferred embodiment of the invention, in the equalizing press a particular equalizing-band loop is employed, by means of whose surface and elasticity properties it is possible to optimize the operation of the equalizing press and to make sure that, after the equalizing press, the web follows the same transfer band on which it was brought into the equalizing press and passed through the press as a run as straight as possible.

The arrangement in a press section of a paper machine for compensating for elongation of a paper web resulting from the equalizing of asymmetry of roughness of the web in an equalizing nip in accordance with the invention, comprises a substantially non-water-receiving, stretchable transfer belt for carrying the web through the equalizing nip. The web has a different roughness on one side thereof than on the other side thereof prior to the equalizing nip whereby the transfer belt carries the web on the less rough side thereof and has a substantially straight run at least after the equalizing nip. The equalizing nip comprises a non-water-receiving press member having a smooth surface structured and arranged to directly contact the web on a rougher side thereof. The arrangement also includes regulation means for regulating a running speed of the transfer belt to stretch the substantially straight run of the transfer belt to compensate for the elongation of the web in the equalizing nip. The regulation means may comprise a transfer-belt drive roll whereby the transfer belt has a transfer sector arranged after the substantially straight run which is concave in relation to a paper-side face of the transfer belt after the equalizing nip and before the drive roll. The web is transferred with a minimal turning angle in the transfer sector from the transfer belt to a drying wire of a dryer section following the press section.

The method for compensating for elongation of a paper web resulting from the equalizing of asymmetry of roughness of the web in an equalizing nip in accordance with the invention comprises the basic steps of carrying the web on a substantially non-water-receiving, stretchable transfer belt through the equalizing nip, and more particularly, by contact with a less rough side of the web, directing the transfer belt in a substantially straight run after the equalizing nip, and regulating a running speed of the transfer belt to stretch the substantially straight run of the transfer belt to compensate for the elongation of the web in the equalizing nip. The regulating step comprises the steps of arranging a transfer-belt drive roll having a transfer sector after the substantially straight run which is concave in relation to a paper-side face of the transfer belt after the equalizing nip and before the drive roll, and transferring the web with a minimal turning angle in the transfer sector from the transfer belt to a drying wire of a dryer section following the press section.

The principles of the invention can be applied in a paper machine including a forming section in which a web is formed, a press section arranged after the forming section and in which the web is dewatered by pressing and a dryer section arranged after the press section and in which the web is dried. To this end, the press section comprises means for passing the web from the pick-up point of the former through the press section to the dryer section in a closed and substantially straight draw, such as one or more press fabrics and a substantially non-water-receiving transfer belt, and a press-roll assembly comprising a plurality of rolls for forming at least one press nip which dewaters the web whereby a last one of the at least one press nip in a running direction of the web is structured and arranged such that thereafter, the web has a different roughness on one side thereof than on the other side thereof An equalizing nip is arranged after the last press nip in the running direction of the web and the transfer belt carries the web through the last press nip and the equalizing nip. The equalizing nip comprises a substantially non-water-receiving press member having a smooth outer face and structured and arranged to directly contact the web on the rougher side thereof in order to reduce the roughness of that side of the web, whereby elongation of the web in the running direction of the web consequently occurs in the equalizing nip. The press section also includes regulation means for regulating a running speed of the transfer belt to stretch the transfer belt after the equalizing nip to compensate for the elongation of the web in the equalizing nip.

In certain embodiments, there is only a single dewatering press nip in the press section, which is preferably an extended-nip press, before the equalizing nip. The press section may include heating means for heating the non-water-receiving press element of the equalizing nip to intensity reduction of the roughness of the rougher side of the web, e.g., internal heaters arranged in connection with the non-water-receiving press member, external heaters arranged in opposed relationship to an outer face of the non-water-receiving press member to directly heat the same, and indirect heaters arranged to heat the web directly in front of the non-water-receiving press member.

In other embodiments, to increase dewatering of the web prior to the equalizing nip, a prepress nip may be arranged in connection with the forming section. In one specific embodiment, the prepress nip is an extended nip and comprising a suction roll arranged in a loop of a forming wire of the forming section and an extended-nip roll having a hose mantle, a press shoe arranged in the hose mantle and loading means for loading the press shoe against the suction roll.

With respect to the construction of the equalizing nip, it is possible to construct the equalizing nip as an extended nip comprising an extended-nip roll arranged in nip-defining relationship with the non-water-receiving press member.

The extended-nip roll has a hose mantle, a press shoe arranged therein and loading means for loading the press shoe against and toward the non-water-receiving press member.

The equalizing nip and elongation compensation techniques used in conjunction therewith described above may be used in so-called closed press sections, which comprise a compact combination of press rolls fitted around a smooth-faced center roll, examples of which include the current assignee's "Sym-Press II"™ and "Sym-Press O"™ press sections. More particularly, in one such closed press section, or center belt press section, there are at least three dewatering press nips, the first being a roll nip, the second being defined by a press roll and a center roll, and the third press nip constituting the last dewatering press nip in the running direction of the web and being defined by an extended-nip roll and the center roll. The transfer belt is guided over the center roll and through the second and third press nips and the equalizing nip. In another closed press section including at least three dewatering press nips, the first is a roll nip defined by a hollow-faced press roll and a suction roll, the second is defined by the suction roll and a center roll, and the third constitutes the last press nip and is defined by an extended-nip roll and the center roll. The transfer belt is guided over the center roll and through the second and third press nips and the equalizing nip.

In the following, the invention will be described in detail with reference to some exemplifying embodiments of the invention illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

FIG. 1A shows an alternative construction for transferring the web from the upper press felt after the first extended nip in the press section shown in FIG. 1.

DETAILED DESCRIPTION OF THE PREFERRED EMBODIMENTS

Figure 1:
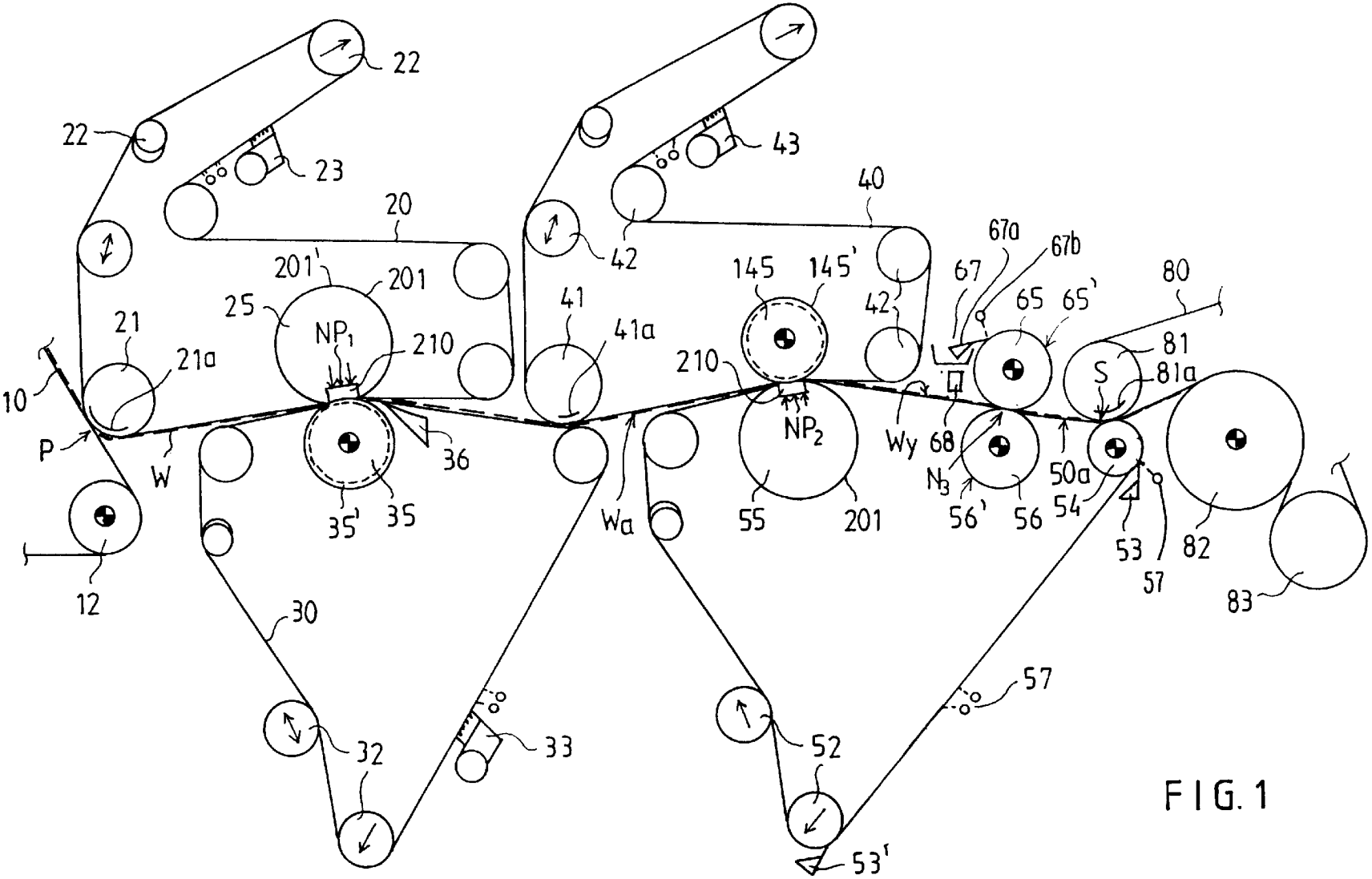
FIG. 1 is a schematic side view of a press section which is provided with a supported transfer of the web and with an equalizing press of roll nip type.

Referring to the accompanying drawings wherein the same reference numerals refer to the same or similar elements, to begin with, the common prior art features of construction of the press section geometries shown in FIGS. 1–4 will be described. According to FIGS. 1–4, with the closed draw of the web W in the paper or board machine, the press section comprises a first upper fabric 20 which receives water, onto which fabric a web W is transferred from a preceding forming section on a suction zone 21*a* of a pick-up roll 21 at a pick-up point P from a forming wire 10, whose return run starts from a wire drive roll 12 situated after the pick-up point P. As shown in FIGS. 1–4, in the press, there are two successive press nips $NP_1$ and $NP_2$, which dewater the web W efficiently and between which the web W has a fully closed almost linear draw so that it is at all times supported by a fabric. Both of the nips $NP_1$ and $NP_2$ are so-called extended nips, whose press zone is substantially longer than that of a normal sharp roll nip. However, these nips may be of another type such as a conventional roll nip.

In FIGS. 1–4, the first upper fabric 20 is guided by alignment, tensioning and guide rolls 22 and conditioned by conditioning devices 23. The first extended nip $NP_1$ includes a water-receiving lower fabric 30, which is guided by alignment, tensioning and guide rolls 32 and conditioned by conditioning devices 33. The first extended nip $NP_1$, and also the second extended nip $NP_2$, are accomplished, for example, by means of the current assignee's "Sym Belt Press"™ press, the details of whose construction come out, for example, from FIG. 10 in the current assignee's Finnish Patent Application 905798 referenced above. With regard to its principal features, the construction of the press is such that the extended nip $NP_1$ is composed of a flexible hose mantle 201 and a back-up roll 35. Inside the hose mantle 201, which is preferably hollow-faced 201', and inside the dewatering-fabric loop 20, there is a hydrostatically and/or hydro-dynamically lubricated glide shoe 210, and the hydraulic loading means arranged in connection with the glide shoe press the glide shoe 210 against the hollow-faced 35' back-up roll 35. The back-up roll 35 is a hollow-faced 35' press roll, for example the current assignee's adjustable-crown "Syin-Z Roll"™.

According to FIGS. 1–4, the press section includes a second upper fabric 40 onto which the web W is transferred as a closed, substantially linear draw by means of the suction zone 41*a* of the suction roll 41. After the first nip $NP_1$, it is ensured that the web W follows the first lower fabric 30 by means of a suction box 36, a suction roll 36A (FIG. 1A) or by means of an equivalent foil arrangement. The second upper fabric 40 is guided by alignment, tensioning and guide rolls 42 and conditioned by conditioning means or devices 43.

In the second extended nip $NP_2$, an extended-nip roll 55 is placed underneath and inside the loop of a transfer belt 50, and an upper back-up roll is a hollow-faced 145' variable-crown press roll 145 which is placed inside the loop of the second upper press fabric 40. The belt mantle 201 of the extended-nip roll 55 may also be hollow-faced, and a hollow face is preferable especially in connection with a slightly permeable transfer belt 50. The relative positions of the extended-nip roll 55 and back-up roll 145 can be switched so that the extended-nip roll 55 is placed above the back-up roll 145, the back-up roll 145 being placed inside the loop of the transfer belt 50 and the extended-nip roll 55 being placed inside the loop of the second upper press fabric 40.

In the invention, the transfer belt 50 runs through the last dewatering press nip $NP_2$ and through an equalizing press nip $N_3$,$NP_3$ as an almost straight run. The transfer belt 50 is guided by guide and tensioning rolls 52 and by a drive roll 54 as well as conditioned by doctors 53 and 53' and by wash jets 57.

According to the invention, after the last extended nip $NP_2$, in connection with the transfer belt, the equalizing nip $N_3$,$NP_3$ is arranged after which the web W is passed as an almost linear closed draw on the transfer belt 50 to a transfer point S and further onto a drying wire 80 to be carried through the dryer section. Since, in the last extended nip $NP_2$, the lower element is a relatively smooth transfer belt 50 which does not receive water to a substantial extent, and the upper element is a "rougher" press fabric 40 that receives water, such as a press felt, after the nip $NP_2$ the roughness of the upper face $W_y$ of the web W unavoidably becomes substantially higher than the roughness of the lower face $W_a$. The difference in roughness is equalized by means of the equalizing nip $N_3$, $NP_3$ in accordance with the invention by pressing the top side $W_y$ of the web W against a smooth face 65',60,201. Also, the z-directional density profile of the web W can be equalized by means of the equalizing nip $N_3$,$NP_3$.

As shown in FIG. 1, the equalizing press nip $N_3$ is formed between an upper smooth-faced 65' press roll 65 and a lower smooth-faced or hollow-faced 56' press roll 56. The surface energy and the adhesion of the smooth face 65' of the upper roll 65 have been selected considerably lower than those of the outer face of the transfer belt 50, so that the web W follows the transfer belt 50 after the nip $N_3$. For cleaning of the smooth-faced upper roll 65 and for removal of broke, a doctor 67*a*, a wash jet 67*b* and a broke trough 67 are used. The press roll 65 may be heated by means of prior art heating devices 68, examples of which include inside steam heating, hot-water heating through a drilled roll mantle, and outside infrared or induction heating. The elevated temperature of the face of the press roll 65 intensifies the smoothing of the roughness of the face of the web W that is placed at the side of the roll.

Figure 2:
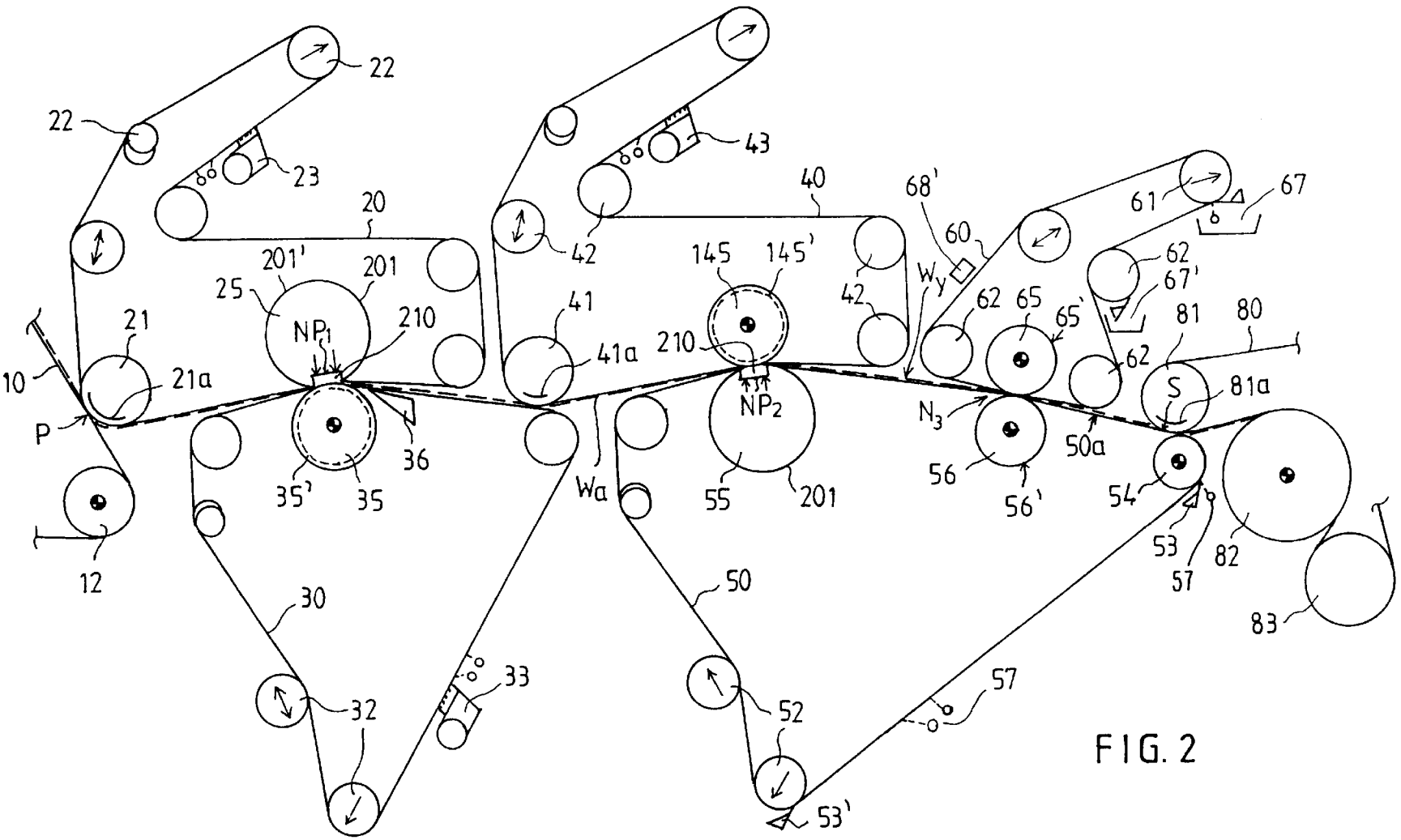
FIG. 2 is an illustration similar to FIG. 1 of a press section in accordance with the invention in which, compared with FIG. 1, additionally a press belt runs through the equalizing press of roll nip type.

The equalizing press nip $N_3$ shown in FIG. 2 is also of the roll type. Through the nip $N_3$, at the top, a particular non-permeable equalizing belt 60 that does not receive water has been arranged to run, the outer face of which belt is quite smooth. The equalizing belt 60 is guided by alignment and tensioning rolls 61 and by guide rolls 62. The surface energy of the outer face of the equalizing belt 60 and the adhesion of that face to the web W are lower than those of the outer face of the transfer belt 50, so that after the nip $N_3$ the web W follows the transfer belt 50. For cleaning of the equalizing belt 60 and for removal of broke, a doctor, a wash jet and a broke trough 67 as well as the doctor and the trough 67' of the guide roll 62 are used. The surface temperature of the equalizing belt 60 can also be raised, for example, by means of an infrared heater 68'.

Figure 3A:
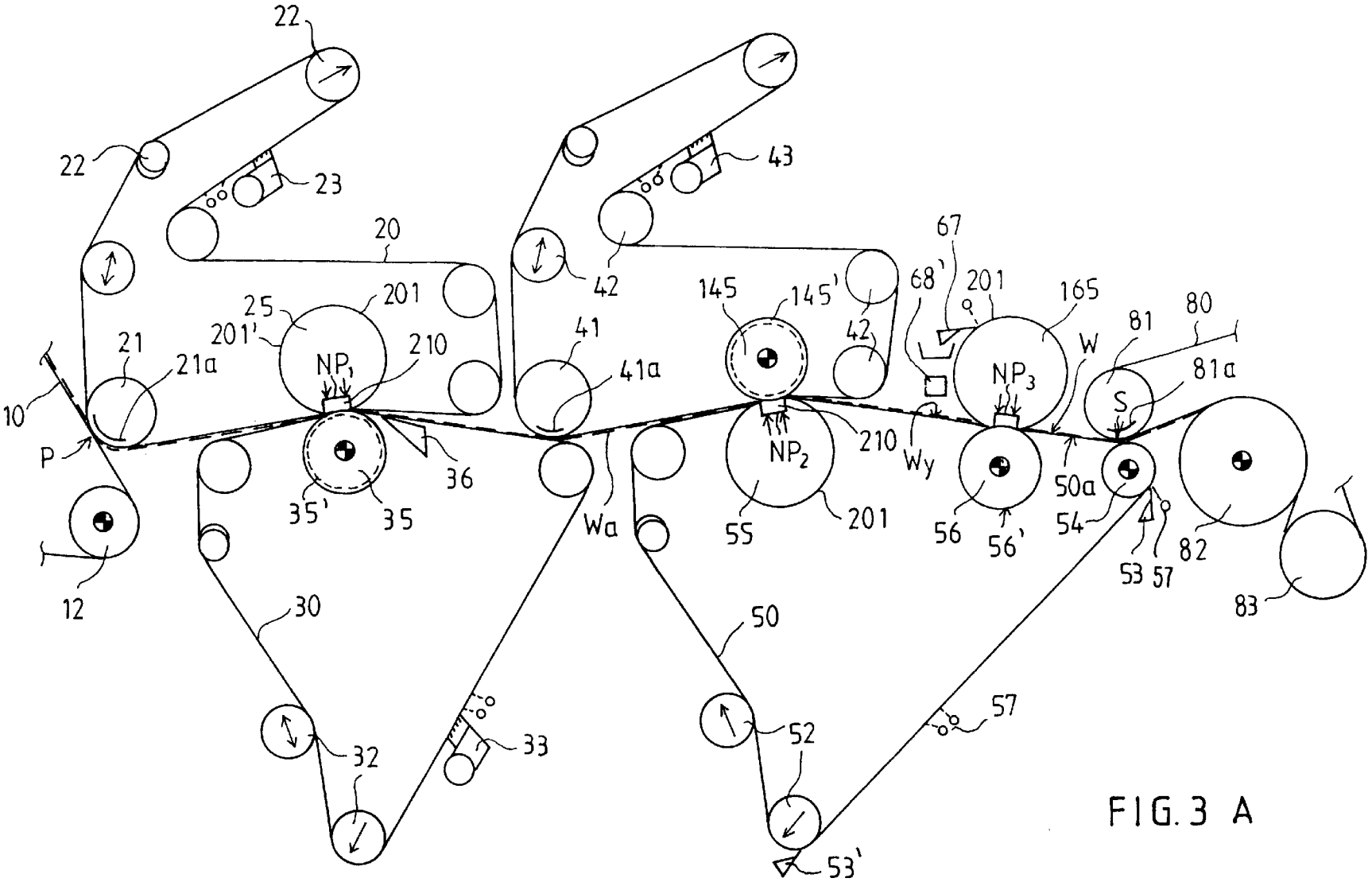
FIG. 3A is an illustration similar to FIGS. 1 and 2 of a press section in accordance with the invention in which there is an extended-nip press as the equalizing press.

In FIG. 3A, the equalizing press nip $NP_3$ placed after the press nip $NP_2$ is of the extended-nip type. The extended nip $NP_3$ is formed between the upper extended-nip roll 165 and the lower smooth-faced 56' press roll 56. The extended-nip zone is formed between the press shoe 210 and the roll face 56'. In the roll 165, there is a hose mantle 201 provided with a smooth outer face, whose surface energy is lower than that of the outer face of the transfer belt 50, so that, after the equalizing step taking place in the nip $NP_3$, the web W follows the lower transfer belt 50. For cleaning of the hose mantle 201 and for removal of broke, a doctor, a wash jet and a broke trough 67 are used. The surface temperature of the hose mantle 201 can also be raised, for example, by means of an infrared heater 68'.

Figure 3B:
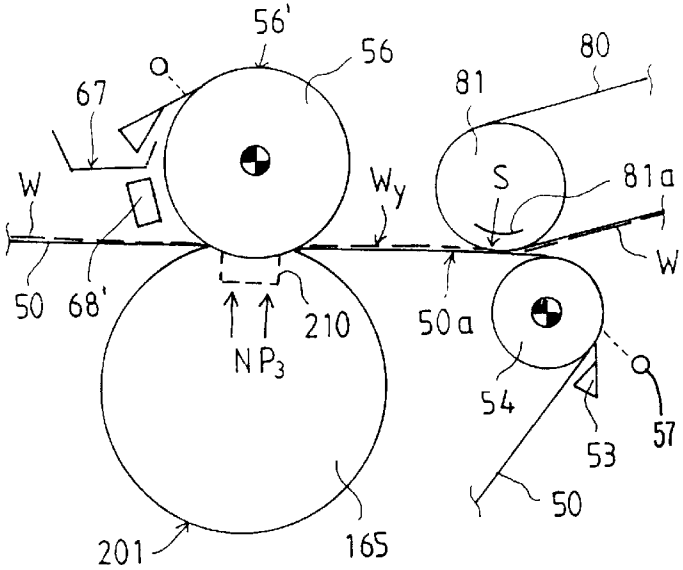
FIG. 3B shows a modification of the extended-nip equalizing press of a press section as shown in FIG. 3A.

FIG. 3B shows a modification of the equalizing press nip $NP_3$ shown in FIG. 3A. The equalizing nip $NP_3$ shown in FIG. 3B differs from the corresponding equalizing press nip $NP_3$ shown in FIG. 3A in the respect that, in FIG. 3B, the extended-nip roll 165 provided with a hose mantle 201 is placed underneath, i.e., inside the loop of the transfer belt 50, and the smooth-faced 56' "rigid" press roll 56 is placed above. The upper press roll 56 is provided with an infrared heater 68', a doctor, a wash jet, and with a broke trough 67 placed in their connection.

Figure 4B:
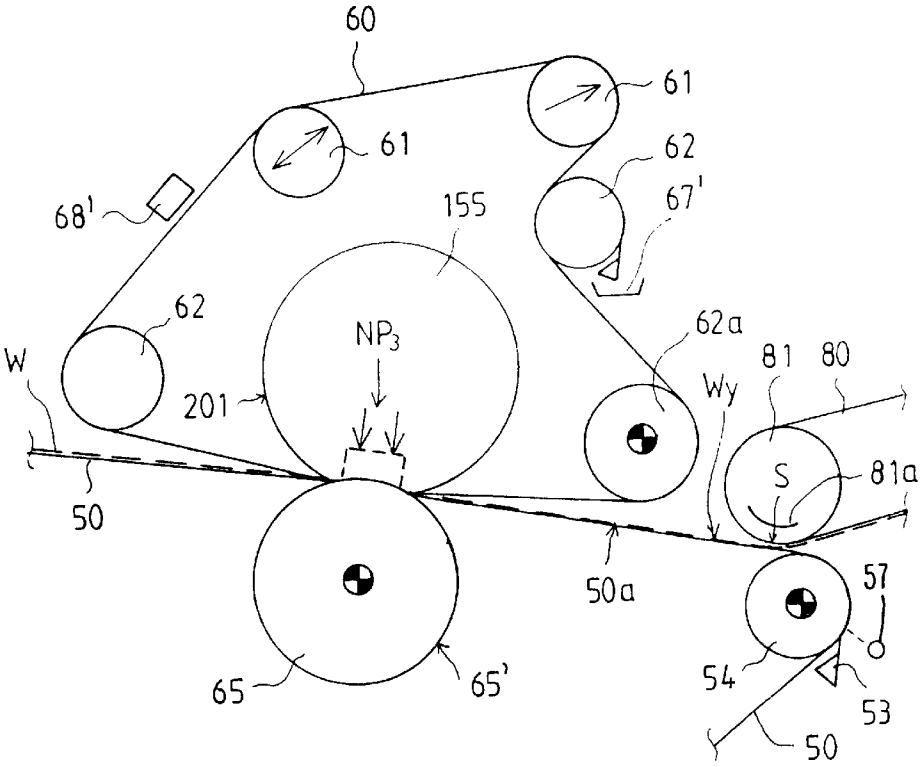
FIG. 4B shows a modification of the extended-nip equalizing press of a press section as shown in FIG. 4A.
Figure 4A:
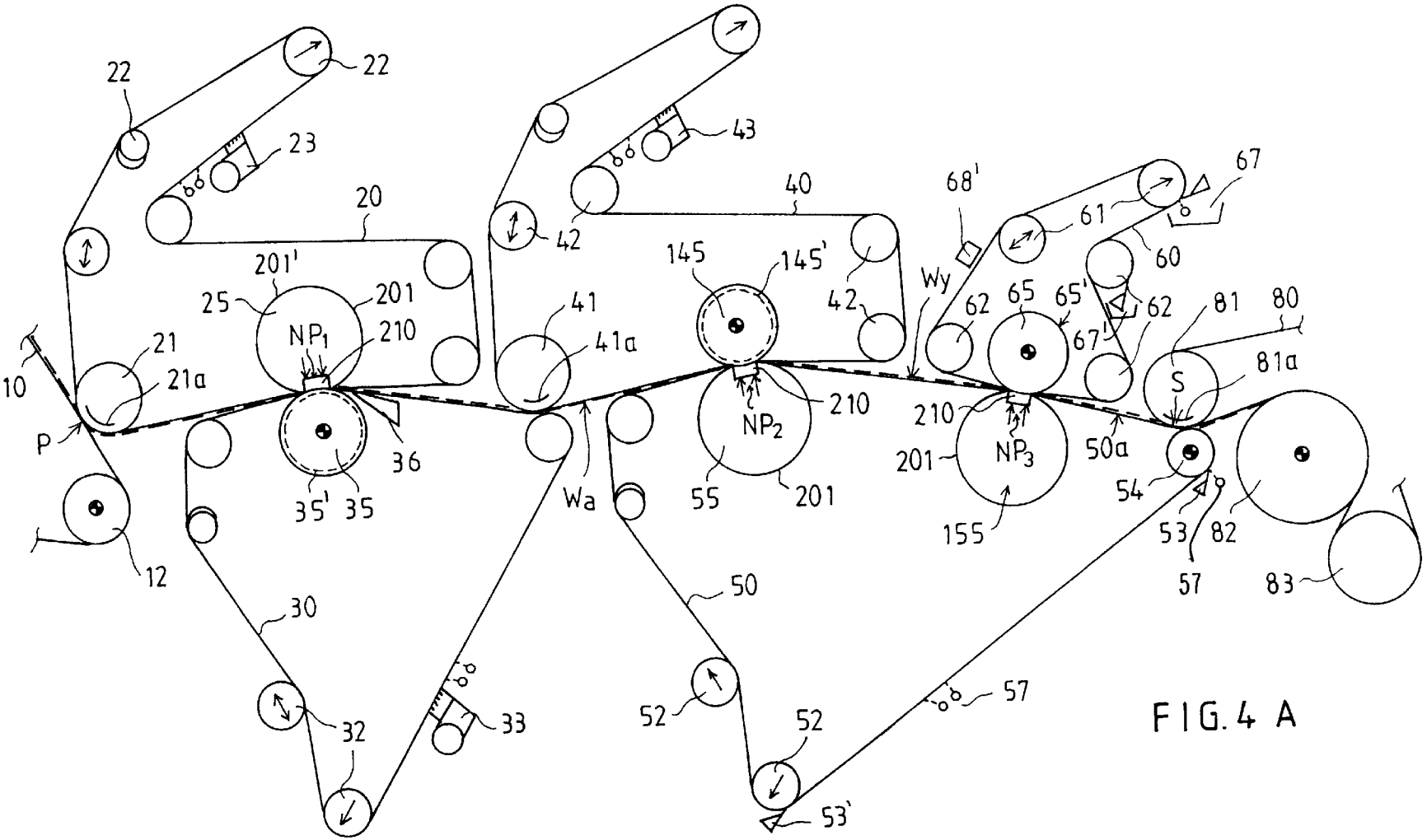
FIG. 4A shows such a variation of the press section as shown in FIG. 3 in which the extended-nip press that operates as an equalizing press is provided with a separate press-belt loop.

In FIG. 4A, the equalizing press nip $NP_3$ is also of the extended-nip type. In the nip $NP_3$, the lower roll 155 is a roll provided with a smooth hose mantle 201, and the upper roll is a smooth-faced 65' press roll 65, around which, additionally, an equalizing belt 60 similar to that described above and running through the nip $NP_3$ is fitted. The equalizing belt 60 is guided by guide rolls 62 and by alignment and tensioning rolls 61. The smooth outer face of the equalizing belt 60 has a surface energy lower than that of the outer face of the transfer belt 50, so that after the nip $NP_3$ the web W follows the transfer belt 50. For cleaning of the equalizing belt 60 and for removal of broke, a doctor, a wash jet, and a broke trough 67 are used. Also on the guide roll 62, there is a doctor and a trough 67' in its connection.

FIG. 4B shows a modification of the extended-nip equalizing press $NP_3$ shown in FIG. 4A. FIG. 4B differs, in respect of the extended nip $NP_3$, from the corresponding extended nip shown in FIG. 4A in the respect that, in FIG. 4B, the lower press component is a smooth-faced 65' "rigid" press roll 65, which is thus placed inside the transfer-belt loop 50. The upper press component in the equalizing press nip $NP_3$ is an extended-nip roll 155 provided with a smooth hose mantle 201, around which roll an equalizing belt 60 runs, which has been arranged in a way similar to FIG. 4A and whose latter guide roll 62*a* is preferably a driven roll.

After the third nip $N_3$,$NP_3$, the web W is transferred on the lower fabric 50 onto a concave transfer sector S, where there is the suction zone 81*a* of the suction roll 81, with whose aid the web W is transferred as a closed and substantially straight draw onto the drying wire 80.

In the equalizing press $N_3$,$NP_3$ arranged in accordance with the present invention, it is a substantially novel feature that, after the equalizing press $N_3$,$NP_3$ the transfer belt 50 runs as a considerably long straight run 50*a* onto the transfer-belt drive roll 54. In the illustrated embodiments, the most essential drive points of various rolls are indicated. There may also be other drive points, for example for the pick-up roll and the transfer-suction roll. By means of regulation of the speed of the drive of the drive roll 54, it is possible to stretch the portion 50*a* of the transfer belt 50 placed between the equalizing nip $N_3$,$NP_3$ and the drive roll 54 so that the elongation of the web W taking place in the equalizing nip $N_3$,$NP_3$ can be compensated for and the run of the web W be kept tight after the equalizing nip $N_3$. The straight joint run 50*a* of the transfer belt 50 and the web W also provides the advantage that on this run it is possible to arrange a concave suction-transfer zone S, which is concave in relation to a paper-side face of the transfer belt, on which the web W is transferred reliably and along an almost linear path onto the drying wire 80, i.e., with a minimal turning angle in the transfer sector S from the transfer belt to the drying wire. The effect of the equalizing press on equalization of the roughness of the web W can also be regulated by means of hardnesses of the faces that press the web W. The ability of a harder material to reduce roughness is better than that of a softer material. Thus, when press nip $NP_2$ is arranged such that the web is provided with a different roughness on one face of the web than on the other face of the web, the rougher side of the web can be pressed in the equalizing press nip $N_3$ by a material whose hardness is higher than the hardness of the press material at the smoother side of the web.

As comes out from the above, the web W has a closed and supported draw when it moves from the pick-up point P of the forming wire 10 to the point S, where it is transferred onto the drying wire 80 of the dryer section and further as a supported single-wire draw at least through the first dryer group. The circumstance that, after each nip, the web W follows the fabric that is supposed to carry the web further is ensured by means of various suction or foil devices, by means of covering angles of the press fabrics, and/or by means of the adhesion properties of the fabrics. Of these devices, the suction boxes 36 are shown in the illustrated embodiments.

Figure 5:
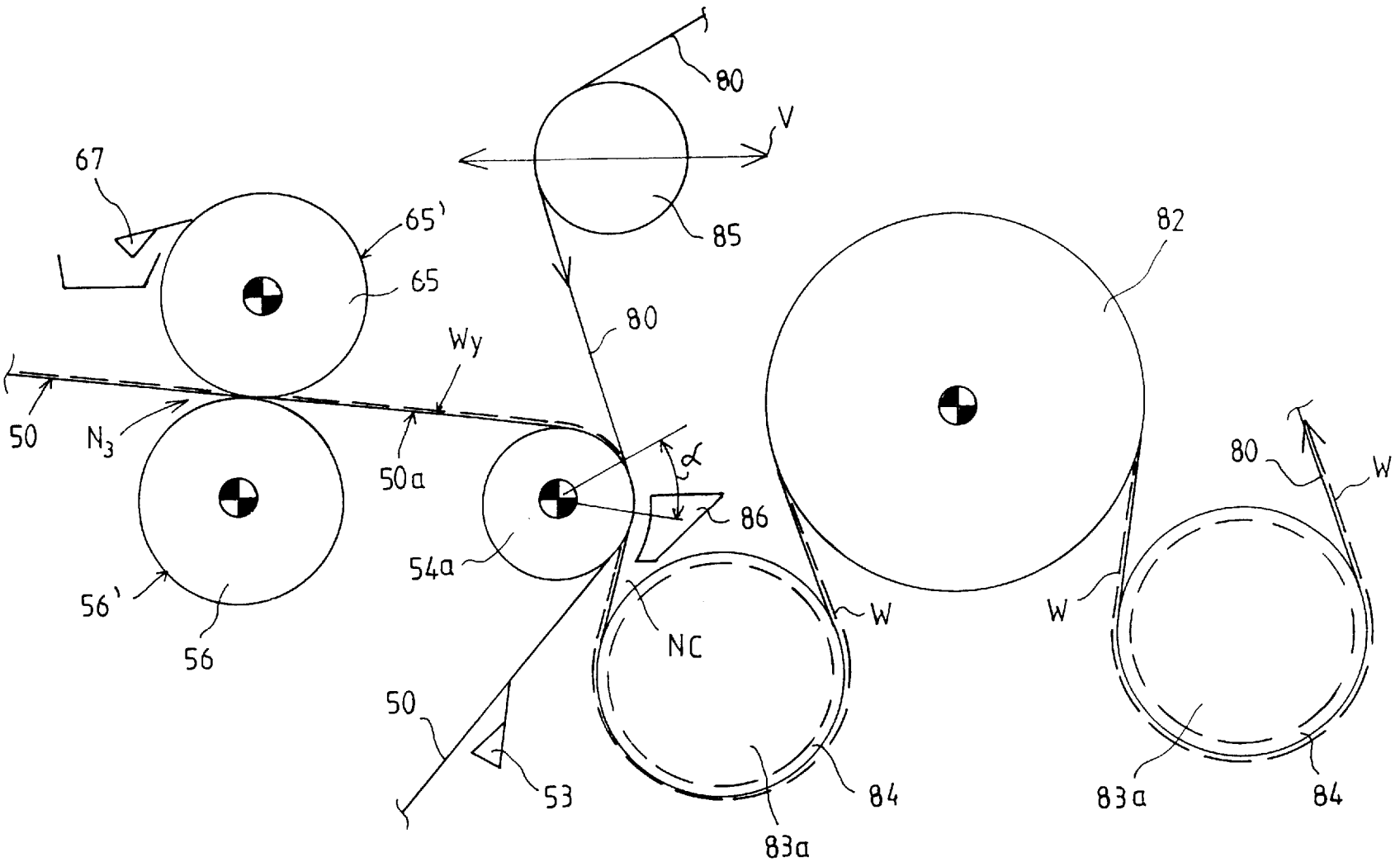
FIG. 5 shows a construction alternative to FIGS. 1–4 for passing the web from the transfer belt to the dryer section.

FIG. 5 shows a particularly advantageous embodiment, as an alternative to the embodiment in FIGS. 1–4, for passing the web W after the equalizing press nip $N_3$ from the transfer belt 50 onto the drying wire 80 of the dryer section and on the drying wire further through the first group with single-wire draw in the dryer section. FIG. 5 shows an embodiment in connection with an equalizing nip $N_3$ as shown in FIG. 1, but it should be emphasized that a closed draw of the web W as shown in FIG. 5 is equally well suitable for use in the press sections shown in FIGS. 2, 3 and 4.

As shown in FIG. 5, after the equalizing nip $N_3$, the transfer belt 50 is passed over the driven guide roll 54*a*. The drying wire 80 is guided by means of a guide roll 85 of adjustable position (the adjustment thereof being represented by arrow V) so that it contacts the web W running over the guide roll 54*a* within the transfer sector α of the guide roll 54*a*, i.e., there is a joint run of the drying wire, transfer belt 50 and web W in sector α. On the transfer sector α, the drying wire 80 presses the web W against the guide roll 54*a*, whereby the web W is transferred reliably to the drying wire 80 and is separated from the transfer belt 50. After the transfer sector α, the drying wire 80 and the web W are passed over a reversing cylinder 83*a*, preferably a suction cylinder marketed by the current assignee under the trade mark VAC-ROLL™. The grooved outer mantle face 84 of the reversing cylinder 83*a* is subjected to a vacuum. In order to prevent pressures induced in the closing nip space NC between the reversing cylinder 83*a* and the drying wire 80 after the transfer sector α, in the nip space NC, a blow box 86 is arranged to produce a vacuum, for example a blow box marketed by the current assignee under the trade mark UNO RUN BLOW BOX™ or equivalent. The magnitude of the transfer sector α is preferably arranged adjustable by changing the position of the guide roll 85 (arrow V). In the threading position, the magnitude of the sector α is generally selected in the range of about 5° to about 45°, and during constant running the sector α is selected in the range of about 0° to about 15°. The transfer of the guide roll 85 can be arranged in a way in itself known, for example, by means of hydraulic or pneumatic cylinders.

From FIGS. 1–4, it can be concluded directly that the run of the web W to be pressed through the press section is highly linear without major bends. Owing to the almost linear path of running of the web, the dynamic forces applied to the web remain sufficiently low in view of minimizing the risk of breaks. The magnitude of an angle of change in direction of the web W is in preferred embodiments in the range of from about 5° to about 30° and, most often, less than about 15°. An exception from this may be constituted by the pick-up roll 21 and by its suction zone, in which even a high vacuum can be employed locally.

In the press constructions described above, an almost linear closed draw of the paper web W is accomplished so that it has been possible to minimize the dynamic forces applied to the web W and the risks of breaks. Thus, the runnability is satisfactory even at high speeds (i.e., from about 30 to 40 meters per second). Moreover, by using extended nips $NP_1$ and $NP_2$ provided with hose rolls in the press section in accordance with the present invention, it has been possible to guarantee an adequate dewatering capacity and dry solids content even at high speeds without applying pressing stages of excessively high peak pressures to the web W.

Figure 10:
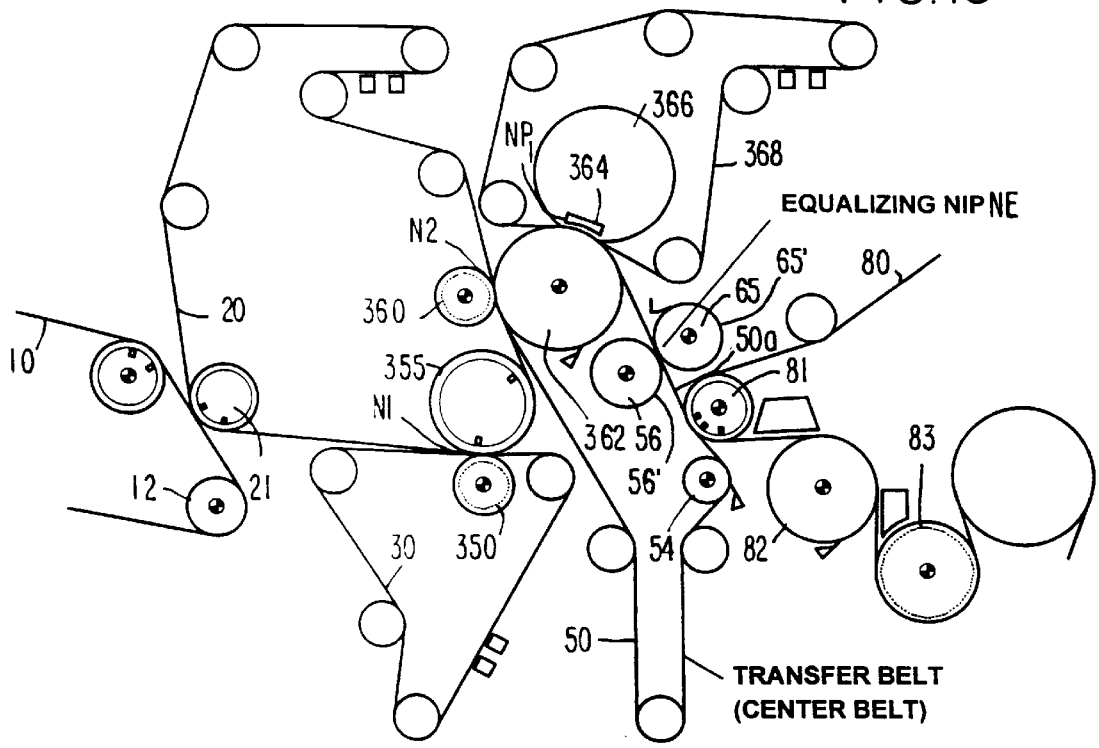
FIG. 10 shows a closed press section having several dewatering nips, an equalizing nip and a center transfer belt which runs over a center roll, and in which the methods and arrangements for compensating for elongation of the web in the equalizing nip in accordance with the invention can be employed.
Figure 11:
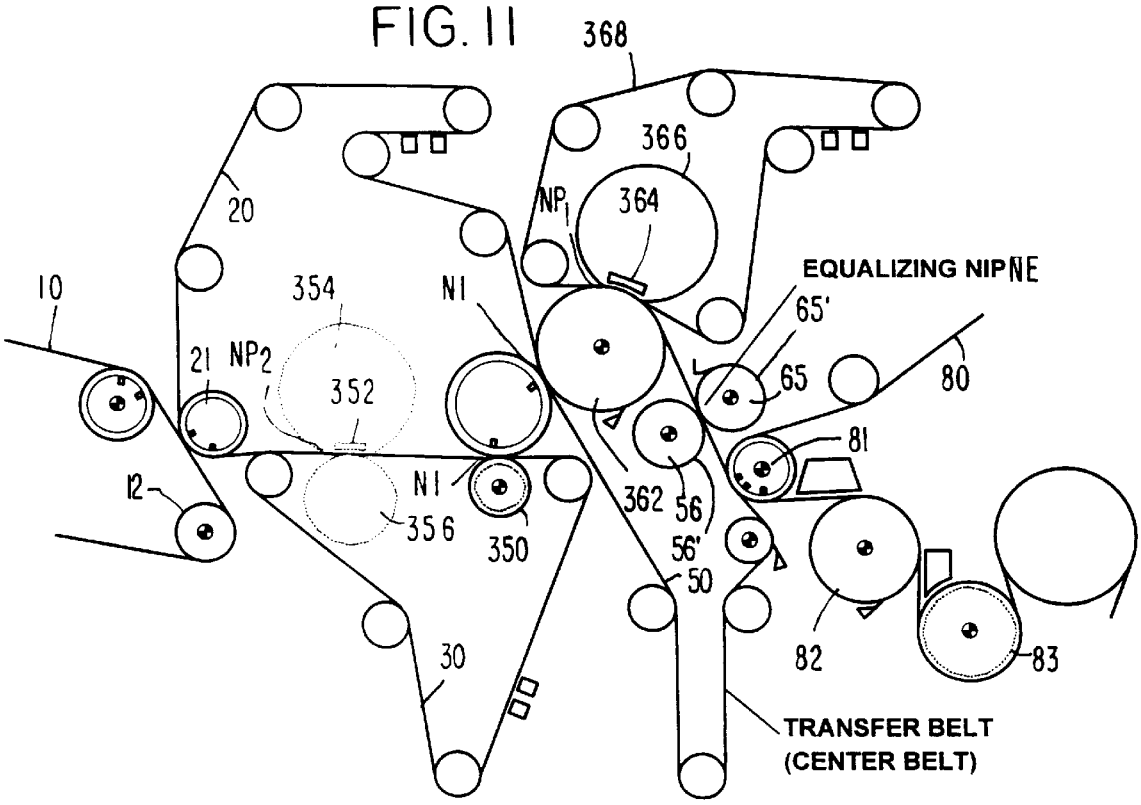
FIG. 11 shows another closed press section having several dewatering nips, an equalizing nip and a center transfer belt which runs over a center roll, and in which the methods and arrangements for compensating for elongation of the web in the equalizing nip in accordance with the invention can be employed.
Figure 12:
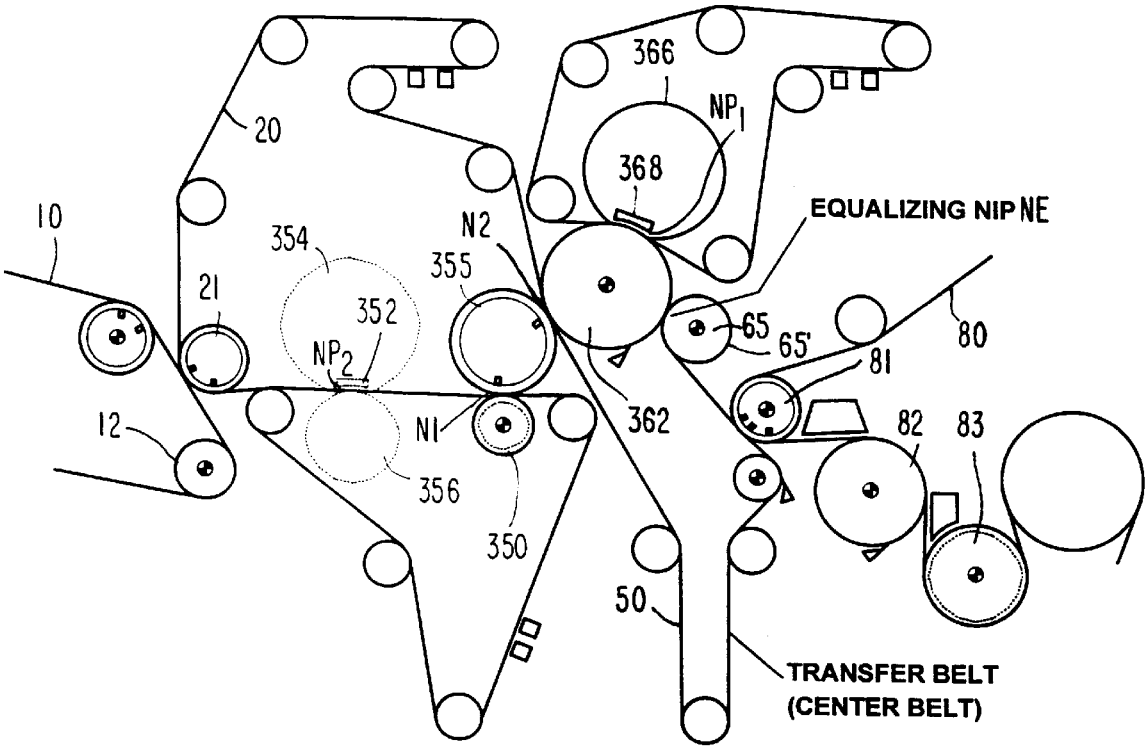
FIG. 12 shows a modification of the closed press section in FIG. 11 wherein the center roll also defines in part the equalizing nip.

The invention can also be applied to other press sections provided with supported transfer of the web, besides those described above by way of example. One alternative environment of application of the invention is, for example, the press section marketed with the trade mark "Center-Belt"™. This type of press section is shown in FIGS. 10–12 and will be described below. Also, it is pointed out that such press section are described in much greater detail in U.S. patent application Ser. Nos. 07/829,989 (which matured into U.S. Pat. No. 5,240,563), 08/025,190 (which matured into U.S. Pat. No. 5,393,383), 08/319,164 (which matured into U.S. Pat. No. 5,611,892), 08/326,581 and 08/326,766, all of which are incorporated entirely by reference herein.

The equalizing press and associated components as described above is very suitable for use in connection with a press section having only a single dewatering nip wherein the stretchable transfer belt which is passed through the equalizing nip is also passed through this single dewatering nip. In this case, dewatering takes places primarily only in that nip and almost completely to that side of a press felt which is against one surface of the web, i.e., the web is dewatered through its face situated against the press felt which sandwiches the web together with the transfer belt in the single dewatering nip. (By contrast, in a press section including several nips, the web may be dewatered through both of its faces.) In view of the dewatering therethrough, the surface of the web on the side of the press felt remains rougher than the surface of the web on the side of the transfer belt. Moreover, the distribution of the mass density of the web in the z-direction becomes asymmetric. In other words, the surface of the web on the side of the felt is made denser than the surface of the web on the side of the transfer belt.

Press sections which include only a single dewatering press nip after the web is transferred from the forming wire are shown in FIGS. 6–9 wherein the same reference numerals denoting the press section components are used as set forth above, and most if not all of the features disclosed above can be included even if not otherwise explicitly stated.

Figure 6:
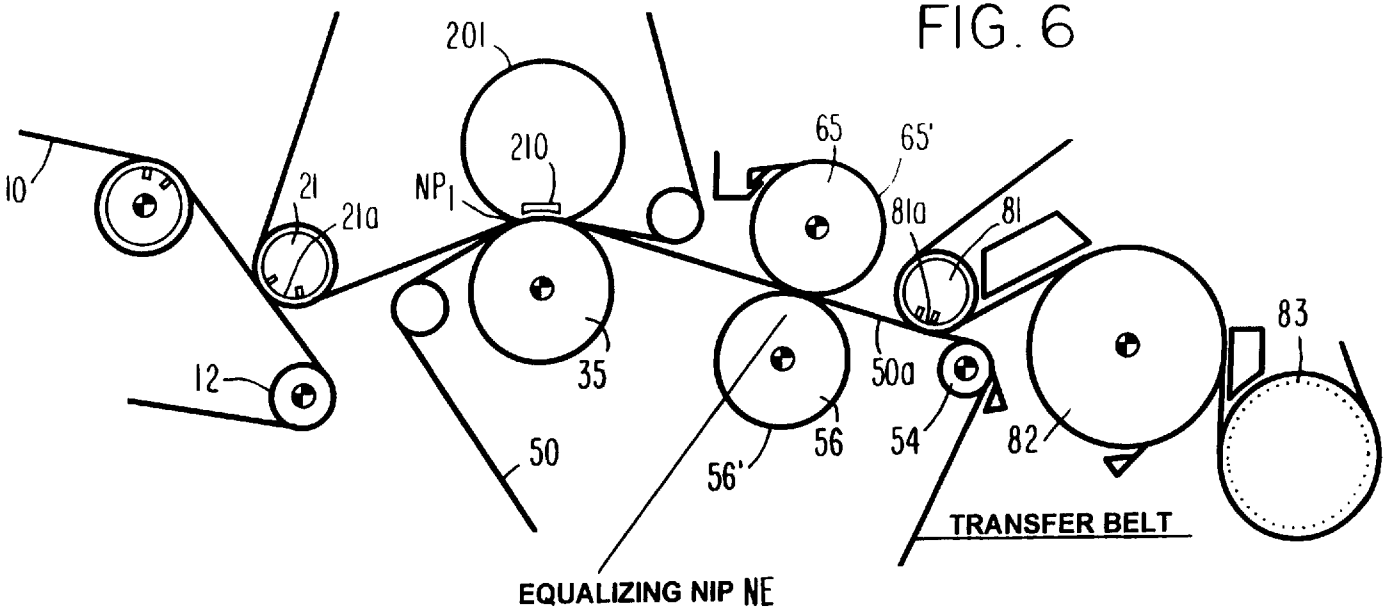
FIG. 6 shows a press section having a single dewatering nip and an equalizing nip and in which the methods and arrangements for compensating for elongation of the web in the equalizing nip in accordance with the invention can be employed.

The press section shown in FIG. 6 includes a single extended nip $NP_1$ which is operated to dewater a web passing therethrough. The web is carried on the transfer belt 50, which is stretchable, into and through the equalizing nip NE. As explained above, in the equalizing nip, the web is pressed to compensate for its unequal roughness which it unavoidably obtains in the extended nip $NP_1$. The equalizing nip $NP_1$ thus rectifies the asymmetry of roughness of the web and the unequal distribution of mass density; however, it is also unavoidably elongated. After the equalizing press NE, the transfer belt 50 runs as the straight run portion 50*a* onto the transfer-belt drive roll 54. By means of regulation of the speed of the drive of the drive roll 54 (in coordination with the speed of the rolls 35, 56 and 65), it is possible to stretch the portion 50*a* of the transfer belt 50 between the equalizing nip NE and the drive roll 54 so that the elongation of the web W taking place in the equalizing nip NE can be compensated for and the run of the web W can be kept tight after the equalizing nip NE. In other words, the surface speed of the drive roll 54 is preferably regulated in consideration of the surface speed of the rolls 35,56,65 in order to achieve the desired stretching of the portion 50*a* of the transfer belt 50 (the rotational speed of rolls 35,56,65 may of course be controlled to this end). The equalizing nip NE is of the roll-nip type, i.e., it is formed between an upper smooth-faced 65' press roll 65 and a lower smooth-faced or hollow-faced 56' press roll 56. The surface energy and the adhesion of the smooth face 65' of the upper roll 65 are selected to be considerably lower than those of the outer face of the transfer belt 50, so that the web W follows the transfer belt 50 after the nip NE.

Figure 7:
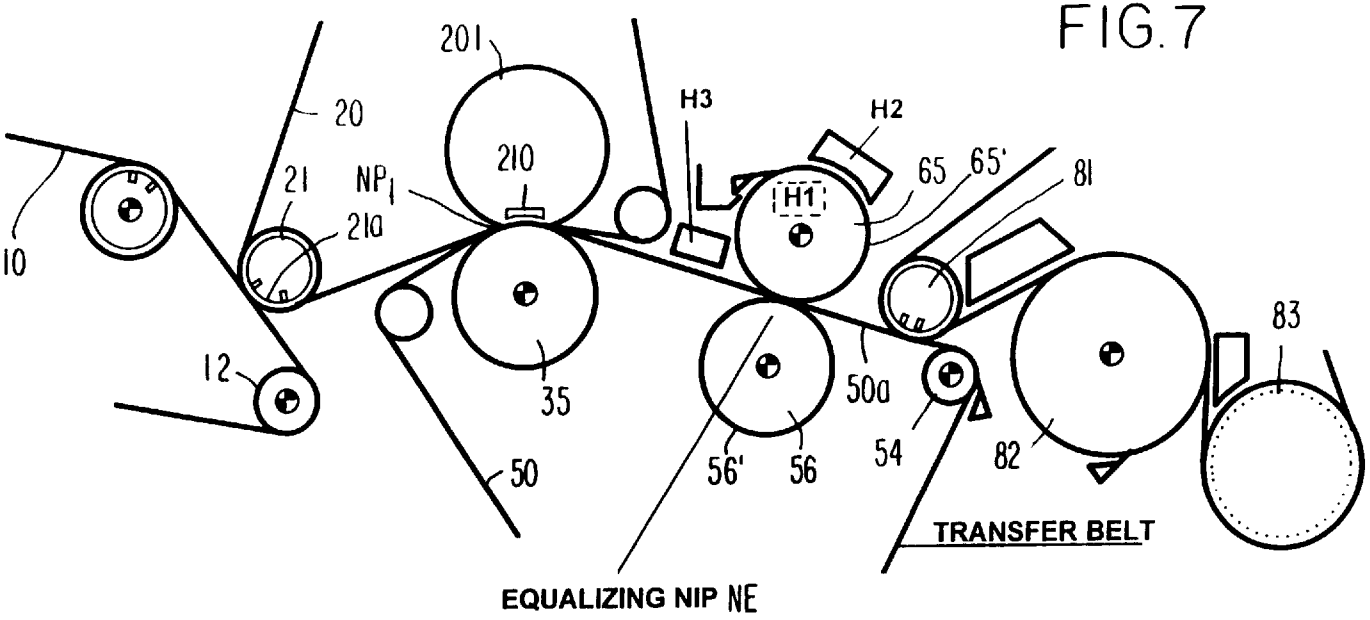
FIG. 7 shows a modification of the press section shown in FIG. 6, including various heating devices for intensifying the equalizing effect provided by the equalizing nip.

FIG. 7 shows a modification of the press section in FIG. 6 which is in most respects similar to that shown in FIG. 6 but additionally includes heating means for intensify the equalizing effect provided by the equalizing nip NE. The heating means may be internal heating means H1 associated with the press roll 65, such as hot-water heating through a drilled roll mantle of press roll 65, or external heating means H2, such as an infrared heater or induction heater, which apply a heating effect directly to the smooth outer face 65' of press roll 65. Other heating means may be used to heat the web before the press roll 65 and after the dewatering press nip $NP_1$, not arranged in direct connection with the press roll 65 so that the press roll 65 is indirectly heated, and such heating means are represented schematically by H3. This type of heating means may be, e.g., a steam heater or an infrared heater. In general, the elevated temperature of the face of the press roll 65 resulting from the heating means intensifies the smoothing of the roughness of the face of the web W that is placed at the side of the press roll 65. These heating means may be applied alone or in combination with one another and in any of the press section disclosed herein for the purpose of intensify the equalizing effect provided by the equalizing nip, i.e., the smoothing of the web therein.

Figure 8:
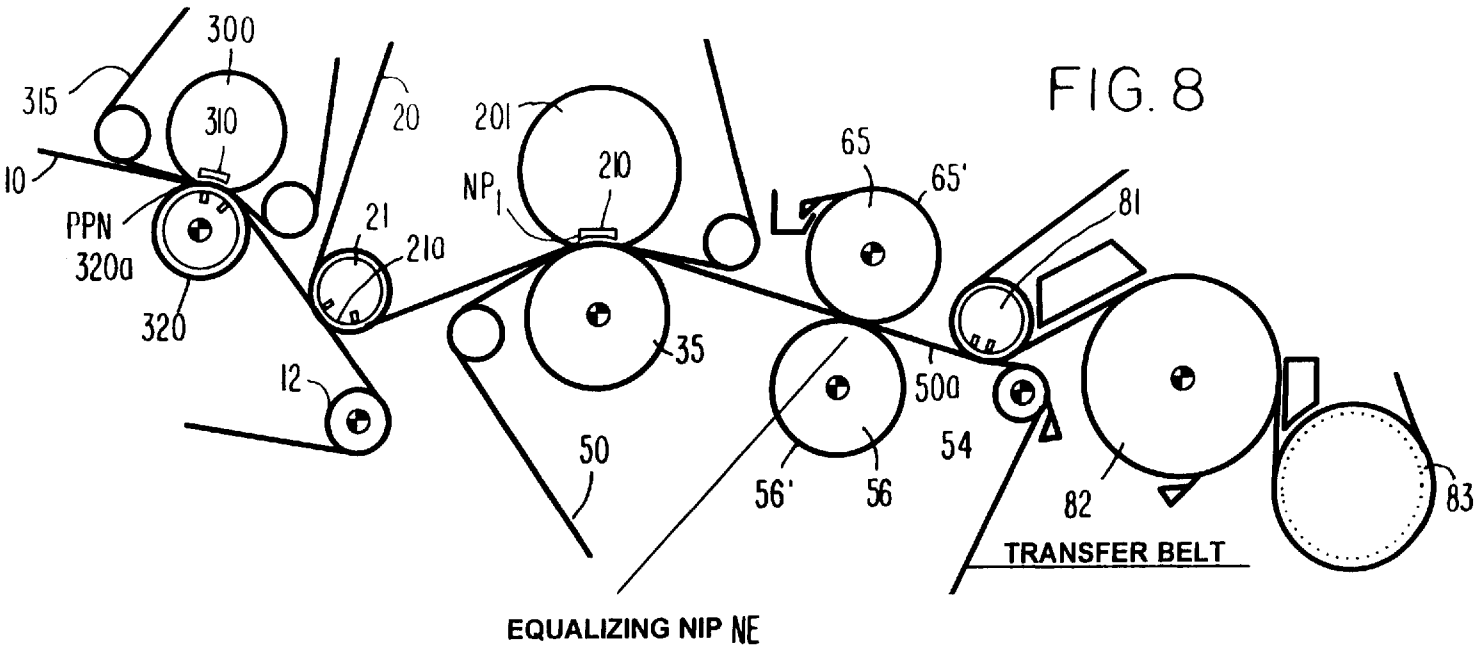
FIG. 8 shows a modification of the press section shown in FIG. 6, including a prepress, i.e., a press nip formed against the forming wire of the forming section.

FIG. 8 shows a modification of the press section in FIG. 6 which is in most respects similar to that shown in FIG. 6 but additionally includes a prepress nip PPN, i.e., a press nip formed against the forming wire 10 of the forming section preceding the press section. The prepress nip PPN is defined by an upper roll 300 of the extended-nip type including a press shoe 310 and a lower suction roll 320 having a suction zone 320*a*. A press felt 315 is guided over the upper roll 300 into contact with the web to receive water from the web in the prepress nip PPN. The prepress nip PPN thus serves to increase the dewatering of the web. The orientation of the roll of the extended-nip type in the prepress nip can be selected in relation to the orientation of the roll of the extended-nip type in the press nip $NP_1$ and/or the transfer belt 50 in an attempt to equalize dewatering of the web and reduce any possible unequal distribution of mass density of the web, i.e., unequal z-directional web density profile. Instead of an extended nip prepress nip, the prepress nip may also be of the conventional roll-nip type.

Figure 9:
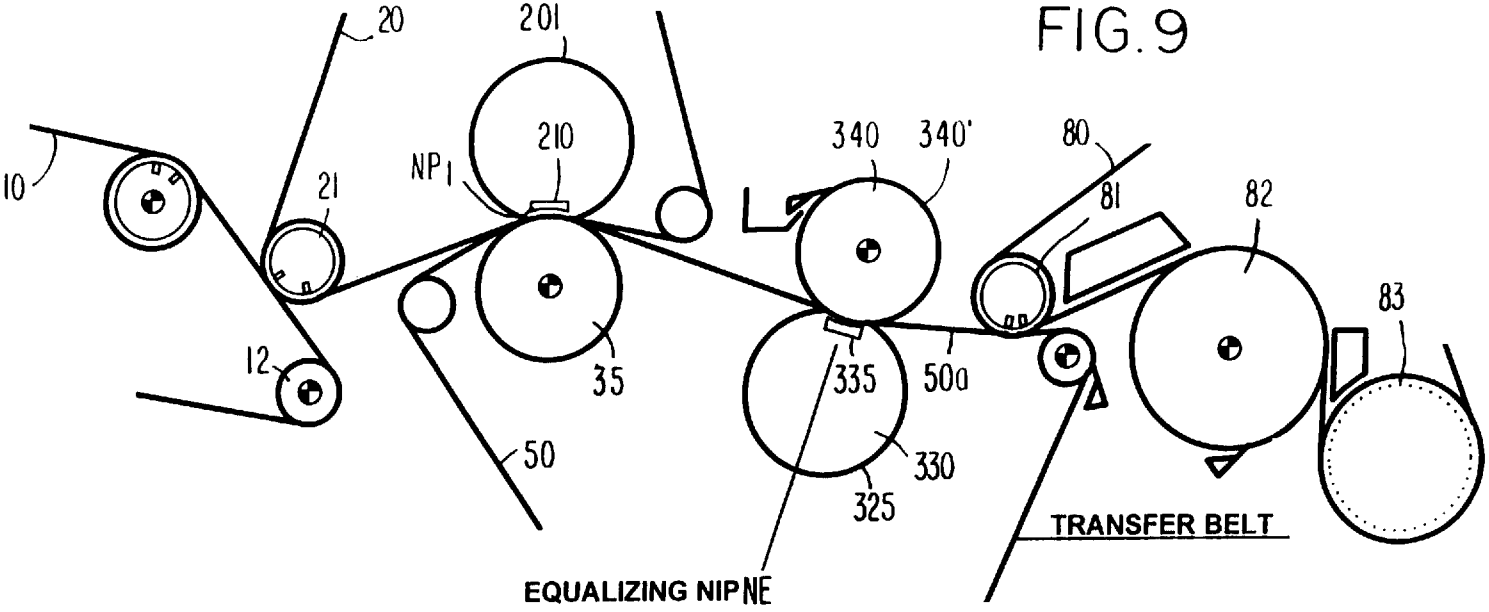
FIG. 9 shows a press section having a single dewatering nip and an equalizing nip, which is of the extended-nip type, and in which the methods and arrangements for compensating for elongation of the web in the equalizing nip in accordance with the invention can be employed.

FIG. 9 shows a modification of the press section in FIG. 6 which is in most respects similar to that shown in FIG. 6, but in FIG. 9, the equalizing nip NE placed after the extended nip $NP_1$ is of the extended-nip type. As such, the equalizing nip NE is formed between a lower extended-nip roll 330 and an upper smooth-faced press roll 340. The extended-nip zone is formed between a press shoe 335 arranged within a hose mantle 325 of the extended-nip roll 330 and the roll face of press roll 340. The surface energy and adhesion of the smooth face 340' of the upper roll 330 are selected to be considerably lower than those of the outer face of the transfer belt 50 so that the web W follows the transfer belt 50 after the equalizing nip NE. For cleaning the face 340' of the upper roll 330 and for removal of broke, a doctor, a wash jet and a broke trough may be used. The surface temperature of the face 340' of the upper roll 340 can also be raised, for example, by means of an infrared heater or other suitable heating means. Other constructions of extended nips can also be used as the equalizing nip and other, different constructions of an extended nip roll can be also be used instead of the particular construction of extended nip roll 330 as described above.

FIGS. 10–12 show a center belt press section in which the transfer belt 50 runs over a center roll against which a plurality of press nips are formed. This press section may be considered a modification of the current assignee's "Sym-Press O"™ press section. In FIG. 10, a first roll nip N1 is formed between a press roll 350 situated in a loop of press felt 30 and a suction roll 355 situated in a loop of press felt 20. The web W is carried on the press felt 20 after the first roll nip N1 and is maintained on suction roll 355 by the presence of a suction zone. The web is carried on press felt 20 from the first roll nip N1 into a second roll nip N2 formed between a press roll 360 and a center roll 362. In the second roll nip N2, the web is transferred onto the transfer belt 50 and carried into and through a third press nip which is an extended nip $NP_1$ formed between the center roll 362 and an extended nip roll 366 including a press shoe 364. A press felt 368 is guided into and through the extended nip $NP_1$ and receives water from the web. The third press nip may be a conventional roll nip instead of an extended nip.

After the extended nip $NP_1$, the web is carried on the transfer belt 50 in a substantially straight run into and through the equalizing nip NE formed between rolls 56 and 65, as described above. As before, by means of regulation of the speed of the drive of the drive roll 54 (in relation to the speed of the rolls 362, 56 and 65), it is possible to stretch the portion 50*a* of the transfer belt 50 placed between the equalizing nip NE and the drive roll 54 so that the elongation of the web W taking place in the equalizing nip NE can be compensated for and the run of the web W be kept tight after the equalizing nip NE. The transfer belt 50 may be conditioned after the web has been removed therefrom and before it receives the web in the second roll nip N2. The surface speed of the drive roll 54 is preferably regulated in consideration of the surface speed of the rolls 362,56,65 in order to achieve the desired stretching of the portion 50*a* of the transfer belt 50 (the rotational speed of rolls 362,56,65 may of course be controlled to this end).

FIG. 11 shows a press section which is a modification of the current assignee's "SymPress II"™ press section. In most respects, this embodiment is the same as that shown in FIG. 10. However, in this embodiment, suction roll 355 is arranged to provide both the first and second rolls nip N1,N2, i.e., suction roll 355 is arranged to define the first roll nip N1 with the press roll 350 and the second roll nip N2 with the center roll 362. Optionally, an extended nip $NP_2$ can be arranged before the first roll nip N1 in the running direction of the web (shown in dotted lines). This additional extended nip $NP_2$ is formed between a solid press roll 356 and an extended nip roll 354 including a press shoe 352.

FIG. 12 shows a press section which is in most respects similar to that shown in FIG. 11. However, in this embodiment, the equalizing nip NE is formed between the smooth-faced press roll 65 and the center roll 362, i.e., press roll 56 is removed. As such, there are three press nips formed against the center roll 362 in this embodiment. This modification may also be applied in any of the other press section concepts disclosed herein, i.e., substituting one of the rolls of a press nip preceding the equalizing nip for one of the rolls of the equalizing nip. This may not be a viable options in all instances in view of the cramped spaces in the area of the equalizing press nip (which causes problems with respect to the removal of broke) and the lack of a drawing force in the transfer belt before the equalizing nip.

Other features of the center belt press section illustrated in FIGS. 10–12 are described in U.S. patent application Ser. Nos. 07/829,989 (now U.S. Pat. No. 5,240,563), 08/025,190, 08/319,164, 08/326,851 and 08/326,766 (all of which are incorporated by reference herein). The features of the center belt press sections described in these patents application can be applied in the press sections shown in FIGS. 10–12.

The examples provided above are not meant to be exclusive. Many other variations of the present invention would be obvious to those skilled in the art, and are contemplated to be within the scope of the appended claims.

I claim:

1. A paper machine including a forming section in which a web is formed, a press section arranged after the forming section and in which the web is dewatered by pressing and a dryer section arranged after the press section and in which the web is dried, the press section comprising means for passing the web from the pick-up point of the former through the press section to the dryer section in a closed draw, said means comprising at least a first press fabric and a substantially non-water-receiving transfer belt, a press-roll assembly comprising a plurality of rolls for forming at least one press nip which dewaters the web, a last one of said at least one press nip in a running direction of the web being structured and arranged such that after said last press nip, the web has a different roughness on one side thereof than on other side thereof, an equalizing nip arranged after said last press nip in the running direction of the web, said transfer belt carrying the web through said last press nip and said equalizing nip and said first press fabric being arranged to run through said last press nip such that the web is situated between said transfer belt and said first press fabric in said last press nip, said transfer belt being structured and arranged to carry the web in a substantially straight run before said equalizing nip and in a substantially straight run after said equalizing nip, said equalizing nip comprising a non-water-receiving press member having a smooth outer face and structured and arranged to directly contact the web on the rougher side thereof in order to reduce the roughness of that side of the web, whereby elongation of the web in the running direction of the web occurs in said equalizing nip, and regulation means for regulating a running speed of said transfer belt to stretch said transfer belt after said equalizing nip to compensate for the elongation of the web in said equalizing nip.

2. The paper machine of claim 1, further comprising heating means for heating said non-water-receiving press member of said equalizing nip to intensify reduction of the roughness of the rougher side of the web.

3. The paper machine of claim 2, wherein said heating means are selected from a group consisting of internal heaters arranged in connection with said non-water-receiving press member, external heaters arranged in opposed relationship to said outer face of said non-water-receiving press member to directly heat said outer face, and indirect heaters arranged to heat the web directly in front of said non-water-receiving press member.

4. The paper machine of claim 1, wherein said non-water-receiving press member is made of a material whose hardness is higher than the hardness of the press material at the smoother side of the web.

5. The paper machine of claim 1, wherein said regulation means comprise a transfer belt drive roll, the dryer section including a drying wire which is arranged to run over a sector of said transfer belt drive roll and the web being transferred from said transfer belt to the drying wire in said sector.

6. The paper machine of claim 5, further comprising a movable drying-wire guide roll over which the drying wire runs before receiving the web in said transfer sector and moving means for moving said drying-wire guide roll, said transfer sector being adjustable upon movement of said drying-wire guide roll via said moving means.

7. The paper machine of claim 5, further comprising a reversing suction cylinder or roll provided with a grooved face subjected to a vacuum, the web being passed after said transfer sector on the drying wire over said reversing suction cylinder or roll onto a first drying cylinder in the dryer section.

8. The paper machine of claim 7, further comprising a blow box arranged in a nip space defined between said reversing cylinder or roll and the drying wire after said transfer sector, said blow box preventing or at least substantially reducing formation of pressures induced in the nip space that interfere with support contact of the web on the drying wire.

9. The paper machine of claim 1, wherein said last press nip comprises an extended-nip press.

10. The paper machine of claim 1, wherein said at least one press nip in the press section comprises a single extended-nip press such that said last press nip is said single extended-nip press.

11. The paper machine of claim 10, further comprising heating means for heating said non-water-receiving press member of said equalizing nip to intensify reduction of the roughness of the rougher side of the web, said heating means being selected from a group consisting of internal heaters arranged in connection with said non-water-receiving press member, external heaters arranged in opposed relationship to said outer face of said non-water-receiving press member to directly heat said outer face, and indirect heaters arranged to heat the web directly in front of said non-water-receiving press member.

12. The paper machine of claim 10, further comprising a prepress nip arranged in connection with the forming section, said prepress nip being an extended nip and comprising a suction roll arranged in a loop of a forming wire of the forming section and an extended-nip roll having a hose mantle, a press shoe arranged in said hose mantle and loading means for loading said press shoe against said suction roll.

13. The paper machine of claim 10, wherein said equalizing nip is an extended nip and comprise an extended-nip roll arranged in nip-defining relationship with said non-water-receiving press member, said extended-nip roll having a hose mantle, a press shoe arranged in said hose mantle and loading means for loading said press shoe against said non-water-receiving press member.

14. The paper machine of claim 1, wherein said at least one press nip comprises at least first, second and third successively arranged press nips, said first press nip being a roll nip, said second press nip being defined by a press roll and a center roll, said third press nip constituting said last press nip and being defined by an extended-nip roll and said center roll, said transfer belt being guided over said center roll and through said second and third press nips and said equalizing nip.

15. The paper machine of claim 1, wherein said at least one press nip comprises at least first, second and third successively arranged press nips, said first press nip being a roll nip defined by a hollow-faced press roll and a suction roll, said second press nip being defined by said suction roll and a center roll, said third press nip constituting said last press nip and being defined by an extended-nip roll and said center roll, said transfer belt being guided over said center roll and through said second and third press nips and said equalizing nip.

16. The paper machine of claim 1, wherein said at least one press nip comprises at least first, second and third successively arranged press nips, said first press nip being a roll nip defined by a hollow-faced press roll and a suction roll, said second press nip being defined by said suction roll and a center roll, said third press nip constituting said last press nip and being defined by an extended-nip roll and said center roll, said transfer belt being guided over said center roll and through said second and third press nips and said equalizing nip, said equalizing nip being defined by said center roll and said non-water-receiving press member.

17. The paper machine of claim 1, wherein said transfer belt is structured and arranged to carry the web between said last press nip and said equalizing nip while in contact with one side of the web and while an opposed side of the web is exposed such that the web is only supported by said transfer belt.

18. The paper machine of claim 1, wherein said last press nip is defined by a first pair of rolls and said equalizing nip is defined by a second pair of rolls other than those of said first pair of rolls.

19. A paper machine including a forming section in which a web is formed, a press section arranged after the forming section and in which the web is dewatered by pressing and a dryer section arranged after the press section and in which the web is dried, the press section comprising means for passing the web from the pick-up point of the former through the press section to the dryer section in a closed draw, said means comprising at least one press fabric and a substantially non-water-receiving transfer belt, a press-roll assembly comprising a plurality of rolls for forming at least one press nip which dewaters the web, a last one of said at least one press nip in a running direction of the web being structured and arranged such that after said last press nip, the web has a different roughness on one side thereof than on the other side thereof, an equalizing nip arranged after said last press nip in the running direction of the web, said transfer belt carrying the web through said last press nip and said equalizing nip, said equalizing nip comprising a non-water-receiving press member having a smooth outer face and structured and arranged to directly contact the web on the rougher side thereof in order to reduce the roughness of that side of the web, whereby elongation of the web in the running direction of the web occurs in said equalizing nip, and regulation means for regulating a running speed of said transfer belt to stretch said transfer belt in a substantially straight run after said equalizing nip to compensate for the elongation of the web in said equalizing nip, said at least one press nip comprising at least first, second and third successively arranged press nips, said first press nip being a roll nip, said second press nip being defined by a press roll and a center roll, said third press nip constituting said last press nip and being defined by an extended-nip roll and said center roll, said transfer belt being guided over said center roll and through said second and third press nips and said equalizing nip.

20. A paper machine including a forming section in which a web is formed, a press section arranged after the forming section and in which the web is dewatered by pressing and a dryer section arranged after the press section and in which the web is dried, the press section comprising means for passing the web from the pick-up point of the former through the press section to the dryer section in a closed draw, said means comprising at least one press fabric and a substantially non-water-receiving transfer belt, a press-roll assembly comprising a plurality of rolls for forming at least one press nip which dewaters the web, a last one of said at least one press nip in a running direction of the web being structured and arranged such that after said last press nip, the web has a different roughness on one side thereof than on the other side thereof, an equalizing nip arranged after said last press nip in the running direction of the web, said transfer belt carrying the web through said last press nip and said equalizing nip, said equalizing nip comprising a non-water-receiving press member having a smooth outer face and structured and arranged to directly contact the web on the rougher side thereof in order to reduce the roughness of that side of the web, whereby elongation of the web in the running direction of the web occurs in said equalizing nip, and regulation means for regulating a running speed of said transfer belt to stretch said transfer belt in a substantially straight run after said equalizing nip to compensate for the elongation of the web in said equalizing nip, said at least one press nip comprising at least first, second and third successively arranged press nips, said first press nip being a roll nip defined by a hollow-faced press roll and a suction roll, said second press nip being defined by said suction roll and a center roll, said third press nip constituting said last press nip and being defined by an extended-nip roll and said center roll, said transfer belt being guided over said center roll and through said second and third press nips and said equalizing nip.

21. The paper machine of claim 20, wherein said equalizing nip is defined by said center roll and said non-water-receiving press member.

* * * * *